United States Patent [19]

Burnett et al.

[11] Patent Number: 4,889,512

[45] Date of Patent: Dec. 26, 1989

[54] DOLL AND PILLOW CARRYING CASE

[76] Inventors: Ronald D. Burnett, 5111 Terrell La., Hampton, Va. 23666; Mildred M. Burnett, 1109 Blair Ave., Hampton, Va. 23669

[21] Appl. No.: 231,677

[22] Filed: Aug. 11, 1988

[51] Int. Cl.[4] ..... A63H 3/02

[52] U.S. Cl. ..... 446/72; 446/75; 5/490; 5/434; 5/485

[58] Field of Search ..... 446/75, 72, 369, 268, 446/76, 77, 71, 371; 5/490, 437, 442, 485, 434, 436

[56] References Cited

U.S. PATENT DOCUMENTS

| | | | |
|---|---|---|---|
| D 86,345 | 3/1932 | Arnold . | |
| D 160,223 | 9/1950 | Smith | 5/434 X |
| D 170,348 | 9/1953 | Aronov . | |
| 1,549,035 | 8/1925 | Van Laar | 446/72 |
| 1,590,927 | 6/1926 | Duncan et al. . | |
| 1,867,422 | 7/1932 | Shapiro | 446/369 |
| 3,789,546 | 2/1974 | Morrison | 5/485 X |
| 4,116,310 | 9/1978 | Shields | 5/434 X |
| 4,277,859 | 7/1981 | Seaman | 5/434 |
| 4,614,505 | 9/1986 | Schneider et al. | 446/321 |
| 4,734,075 | 3/1988 | Park | 446/321 |

FOREIGN PATENT DOCUMENTS

| | | | |
|---|---|---|---|
| 2202835 | 7/1973 | Fed. Rep. of Germany | 446/369 |

*Primary Examiner*—Mickey Yu
*Attorney, Agent, or Firm*—Wallace J. Nelson

[57] ABSTRACT

A combination toy including a decorative pillow 15 and a soft sculptural human figure doll 11 is disclosed. Pillow 15 is provided with a soft filler material 21 housed with a decorative exterior cover. A pocket 13, of essentially the same peripheral measurements as pillow 15, is permanently attached to both sides and one end and unattached to the pillow end having a handle 17 attached thereto. Legs 25, 26 are folded back over the doll body and doll 11 is positioned within pocket 13 of pillow 14. An elastic band 18 attached to the open end of pocket 13 serves to engage doll 11 beneath the armpits for releasable retention therein. A pair of buttons 36, 37 are also secured to the exterior of pocket 13 and serve to engage button holes **36*a* and 37*a* formed in the dress arms of doll 11 as a further retention element for the doll. When doll 11 is removed from pocket 13, elastic band 18 biases the open end of the pocket against pillow 15.**

Legs 25, 26 and arms 45, 46 are essentially circular in cross-section and are provided with flat stitched joints to facilitate bending or folding of the limbs. The filler material for pillow 15 and doll is selected from the group of filler materials consisting of cotton, nylon and foam rubber.

1 Claim, 4 Drawing Sheets

DOLL AND PILLOW CARRYING CASE

FIELD OF THE INVENTION

This invention relates generally to toys and relates in particular to a doll and a pillow storing/carrying case for the doll.

BACKGROUND OF THE INVENTION

The favorite toy for most young girls continues to be the doll. Most pre-teens own several dolls and they enjoy dressing up the dolls, playing with them and otherwise simulating motherhood. Few children are allowed to, or really want to, take one of their dolls to church. For the pre-school child, the doll can serve as a a quiet companion that helps the child avoid boredom or becoming restless and fidgety during church service. Also, many times small children become tired during church services and they prefer to lay down in the pews and maybe take a nap. The parents also would prefer that the child lay down and rest instead of becoming cranky and noisy. A pillow would thus be a welcome item during these restless times. Pillows, alone make poor toys, but when you can combine a doll and a pillow together, with each performing their separate but cooperating functions, you have an ideal solution to this problem. Such combination would appear to benefit both child and parent.

SUMMARY OF THE INVENTION

Accordingly, it is an object of the present invention to provide a combination soft sculptural doll and attached pillow carrying case.

Another object of the present invention is a pillow carrying case for a soft sculpture doll that may be used as a pillow alone or with the doll contained therein.

A further object of the present invention is a pillow carrying case for a doll having a handle disposed on one end thereof.

An additional object of the present invention is a pillow having a pocket on one side thereof for releasably retaining a doll therein.

Another object of the present invention is a doll carrying case that releasably retains a doll therein and also serves as a pillow for the doll and/or the owner.

Another object of the present invention is a soft sculptural doll that may be dressed or easily changed into several outfits by a small child and that may be carried and/or stored in a complementary pillow carrying case.

According to the present invention the foregoing and additional objects are attained by providing a pillow having a decorative exterior cover enclosing a soft filler material and a handle attached to one end thereof. A pocket is attached to the exterior of the decorative cover on three sides and unattached at the side or end adjacent to the handle. A soft sculptural doll is releasably retained within the open end of the pocket. The carrying case may be used a a pillow alone, or with the soft sculptural doll therein. Also, the doll may be removed from the pocket and permitted to sit or lay on the pillow. An elastic band is disposed along the edge of the open pocket and serves to releasably retain the doll within the pocket and, when the doll is removed therefrom, the elastic band maintains the open pocket end against the main pillow body portion.

BRIEF DESCRIPTION OF THE DRAWINGS

A more complete appreciation of the invention and many of the attendant advantages thereof will be more readily appreciated as the same becomes better understood by reference to the following detailed description when considered in connection with the accompanying drawings wherein.

DETAILED DESCRIPTION

Figure 1:
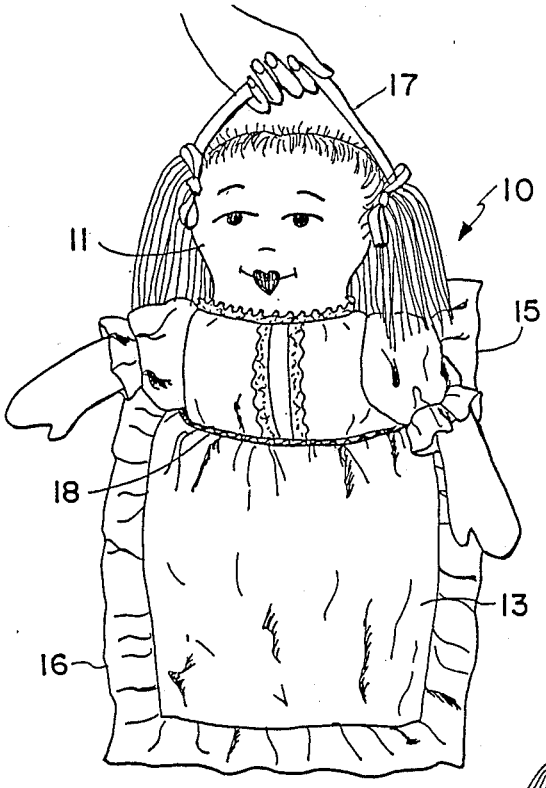
FIG. 1 is a front perspective of the soft sculptural doll and pillow carrying case therefor according to the present invention.
Figure 2:
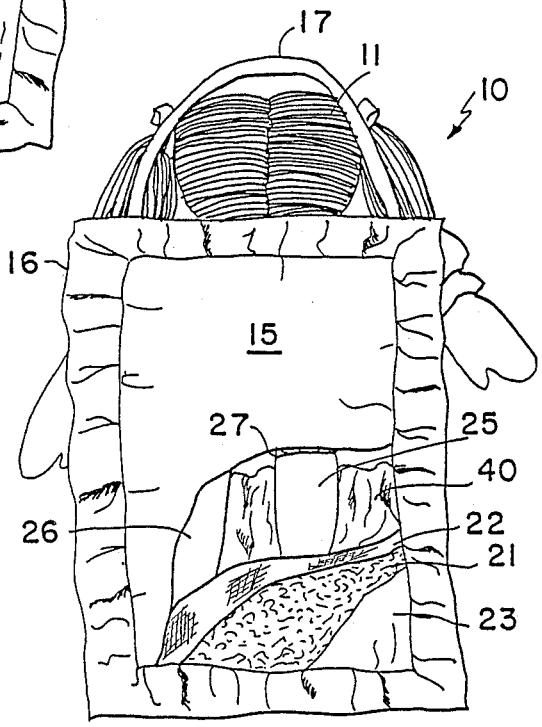
FIG. 2 is a rear view of the doll and pillow shown in FIG. 1 with parts broken away.
Figure 3:
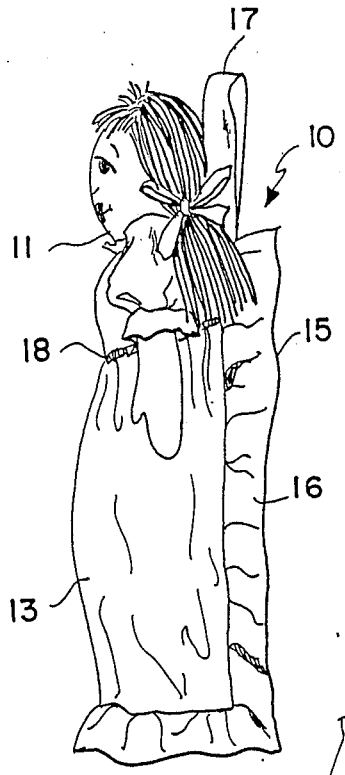
FIG. 3 is a side view of the doll and pillow carrying case shown in FIG. 1.

Referring now to the drawings, the combination toy, including a soft sculptural doll and pillow carrying case therefor, is shown in FIGS. 1–3 and designated generally by reference numeral 10. Toy 10 includes a soft sculptured doll 11 disposed in an open pocket 13 formed on the face of a pillow 15. A decorative border 16 of ruffles, lace, or the like, is provided around the peripheral edges of pillow 15. A handle 17 is secured to the end of pillow 15 adjacent to the open end of pocket 13. An elastic band 18 is secured to the open end of pocket 13 with the two sides and other end of the pocket being attached to pillow 15. As illustrated, pocket 13 has essentially the same peripheral dimensions as pillow 15. Elastic band 18 serves to maintain open pocket 13 against soft sculptural doll 11 to assist in releasably retaining doll 11 within pocket 13. Elastic band 18 causes open pocket 13 to snugly fit beneath the armpits of doll 11 and serves to position the open end of pocket 13 biased against pillow 15 when doll 11 is removed therefrom.

Referring now more particularly to FIG. 2, pillow 15 includes a soft filler material 21 disposed between front 22 and rear 23 fabric panels sewn or otherwise connected together by a peripheral seam. Border 16 is attached to pillow 15 along this same seam. The inside or front panel 22 of pillow 15 is normally obscured from view by pocket 13 and/or doll 11. The legs 25,26 of doll 11 fold at the connection thereof with the doll body to permit their being doubled over the back of doll 11 when the doll is inserted within pocket 13. Legs 25,26 are also provided with foldable or bendable joints at essentially the midpoint of the length thereof to give a more life-like appearance to the doll when disposed in the sitting position. These foldable joints are formed by providing an essentially flat stitching area to the legs at the "knees" and "hip" area, as will be more fully explained hereinafter. One "knee" joint is shown in FIG. 2 and designated by reference numeral 27. Legs 25,26 (as well as the head, body and arms of doll 11) are formed of cotton or other soft fabric and filled with a suitable soft filler material. The unattached ends of legs 25,26 are in the form of a simulated foot, as will be further explained hereinafter, to permit respective booties 31,32 (FIG. 4) to be retained thereon. The flat connection of legs 25,26 to the "hip" or body area of the doll body permit freely bending of the legs and facilitate stowing doll 11 in pocket 13. The remaining portions of legs 25,26 are essentially circular in cross-section. For purposes of illustration, the folded legs 25,26 are shown in FIG. 2 without the pantaloons 34 (FIG. 4) normally provided for doll 11.

Figure 5:
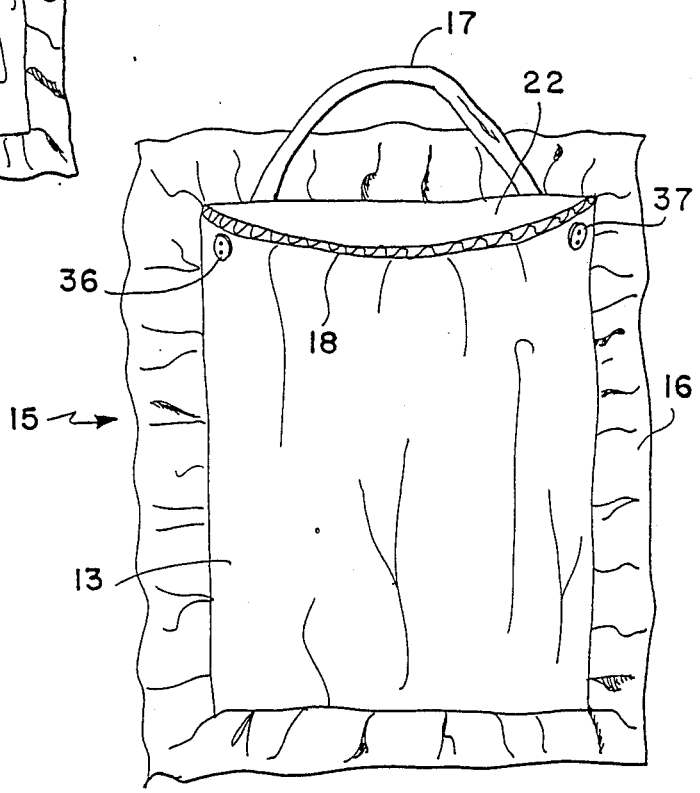
FIG. 5 is a view of the pillow carrying case shown in FIG. 1 after removal of the doll therefrom.
Figure 4:
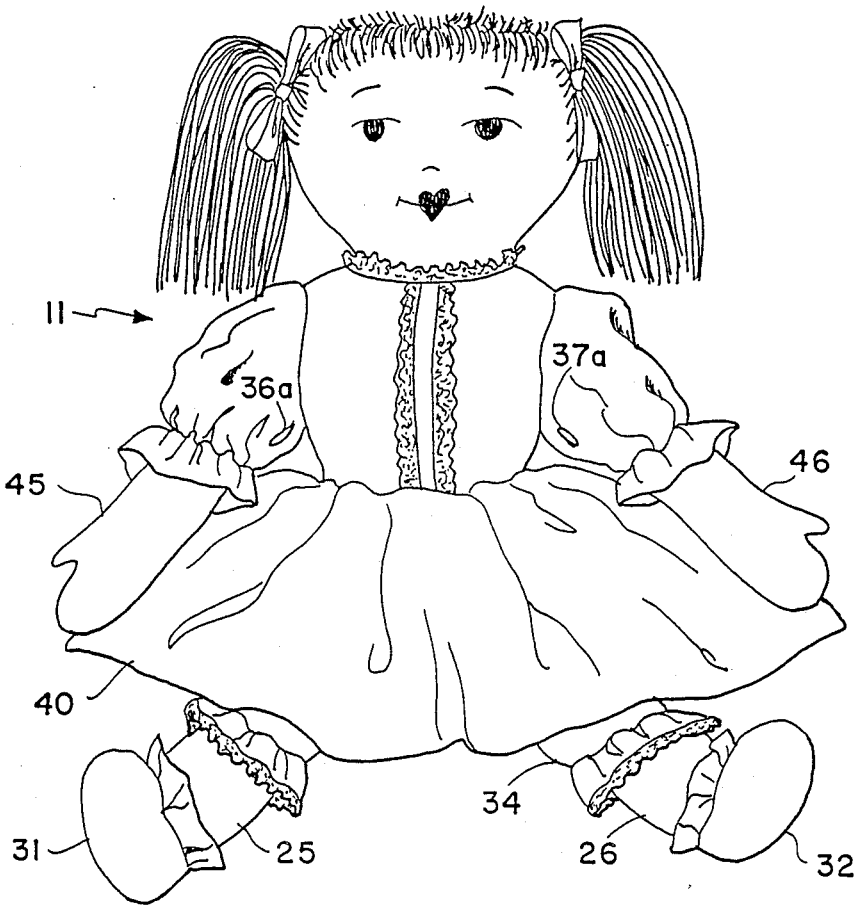
FIG. 4 is a view of the doll shown in FIG. 1 when removed from the pillow carrying case.
Figure 6:
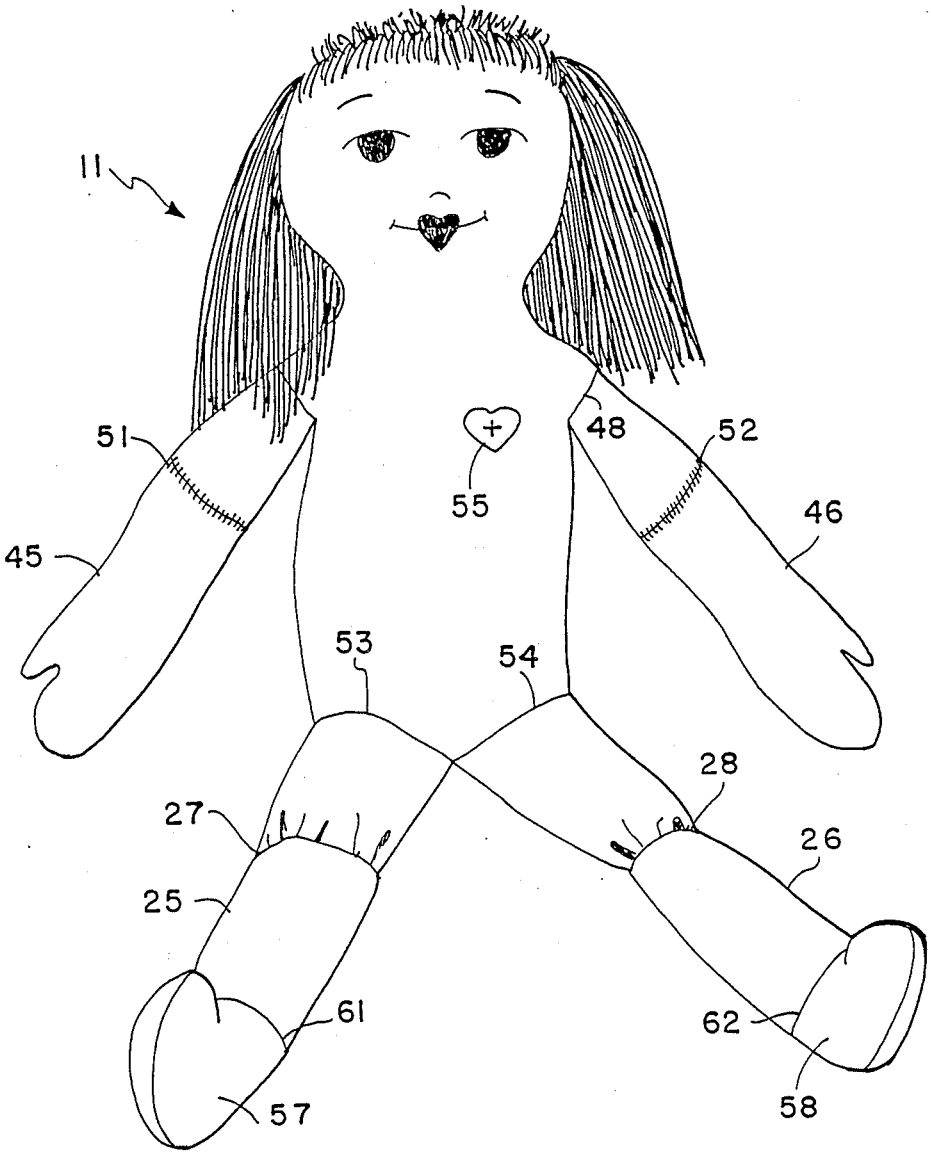
FIG. 6 is a view of the doll shown in FIG. 4 prior to being dressed and prior to hair styling.

Referring now more particularly to FIGS. 4–6, pillow 15 and doll 11 are shown when separated. As shown in FIG. 5, pillow 15 is provided with a pair of buttons 36,37 on the exterior of pocket 13 and adjacent to the ends of elastic band 18. A pair of button holes **36*a*,37*a* are provided, one each, on the sleeve armpits of dress 40 on doll 11 (FIG. 4) and serve to receive buttons 36,37, respectively, when doll 11 is positioned within pocket 13. In lieu of the button/button hole connection, conventional snap fasteners, VELCRO fabric strips or other fabric having interconnecting extensions thereon, may be employed as the releasable connection for doll 11 and pillow 15**.

As shown more particularly in FIG. 6, arms 45,46 are also essentially circular in cross-section and are connected to the doll body by a flat stitched area, with a similar flat stitched area provided at substantially the mid-length or "elbow" of each arm. The body-arm connection for arm 45 is not shown in the FIG. while that for arm 46 is designated by reference numeral 48. The elbows of arms 45, 46 are designated by reference numerals 51,52 respectively. Arms 45,46 terminate in simulated soft hands that give the appearance of a child wearing mittens. Legs 25,26 also have flat stitching at the "knee" area, as designated by reference numerals 27,28, to facilitate folding or bending of the legs. Similar flat stitched connections 53,54 respectively, connect legs 25,26 to the body of doll 11. This leg/body connection permits doll 11 to be placed in a sitting position resting on the body bottom alone, or on the body and thigh portions of the legs, with knees 27,28 permitting the lower leg portions to dangle.

A heart emblem enclosing a cross is embroidered on the left breast area of doll 11 in the embodiment shown, to help teach the child (doll's owner) Christian values and concerns. Other religious or appropriate indicia or symbols may be substituted for the heart and cross shown.

The yarn "hair" for doll 11 may be of any color and is shown in the unstyled condition in FIG. 6. This "hair" is readily adaptable to be left hanging loose, as shown, tied in a single pony tail, or tied with double bows, as shown in FIG. 4. Doll 11 is shown dressed in its church finery in FIG. 4 but is adaptable for various outfits to simulate the child's vision of a working or leisure environment. Due to the easy manipulation of the arms and legs, even the very young child can master changing of the doll clothes and shoes. The simulated feet 57,58 are stitched to legs 25,26 respectively, via circular stitching areas 61,62. Feet 57,58 also contain the same soft filler material as the rest of doll 11 and are readily adaptable for receiving various types of shoes or booties.

In the preferred embodiment shown, doll 11 is twenty and one-half inches tall and is made of cloth and yarn. The doll hair is four ply yarn and all facial features, including the heart shaped mouth and lines extending from each side thereof, are embroidered. Pillow 15, in the preferred embodiment, is fifteen by twelve inches (excluding the ruffle or lace border). Pocket 13 is of these same dimensions and it is necessary that legs 25,26 be folded to permit insertion of the doll (up to its armpits) therein. The filler for doll 11 and pillow 15, in the preferred embodiment, is cotton batting but other fillers such as, nylon, foam rubber and the like, may also be employed.

Although the invention has been described relative to specific embodiments thereof, it is not so limited and numerous variations and modifications thereof will be readily apparent to those skilled in the art in the light of the above teachings.

It is therefore to be understood that, within the scope of the appended claims, the invention may be practiced other than as specifically described.

What is claimed as new and desired to be secured by U.S. Pat. Nos. is:

1. A soft sculptural toy comprising in combination:

(a) a pillow having a decorative exterior cover;

(b) a soft filler material enclosed within said decorative exterior cover, said soft filler material being selected from the group of filler materials consisting of cotton, nylon, and foam rubber;

(c) a handle attached to one end of said pillow;

(d) a pocket attached to the exterior of said decorative exterior cover, said pocket having essentially the same peripheral measurements as said pillow and permanently attached to both sides and one end thereof, and unattached to the pillow end having said handle attached thereto;

(e) a soft sculptural human figure doll positioned within said pocket and extending from the end thereof that is not permanently attached to said pillow; said doll being of a length substantially exceeding the length of said pillow and having a head, a body, a pair of arms and a pair of legs, and wherein said legs are folded back over and behind the doll body to permit insertion of said doll within said pocket; said doll having an exterior constructed of cloth and yarn and a soft filler material interior selected from the group of filler materials consisting of cotton, nylon, and foam rubber;

(f) means for releasably retaining said doll within said pocket, said means for releasably retaining said doll within said pocket including an elastic band extending the length of and connected to the end of said pocket that is not permanently attached to said pillow, said elastic band engaging said doll beneath the arms thereof and serving to elastically bind against said doll to releasably retain said doll body and legs within said pocket while leaving exposed said head and arms of said doll, and when said doll is removed from said pocket, said elastic band serving to bias the unattached end of said pocket against said pillow; and (g) cooperating connecting means disposed on the exterior of said pocket and beneath the arms of said doll, said cooperating connecting means being selected from the group of connecting means consisting of (a) button/button holes, (b) snap fasteners, and (c) strips of fabric having interconnecting extensions thereon.

* * * * *